United States Patent [19]

Dennis

[11] Patent Number: 4,562,933

[45] Date of Patent: Jan. 7, 1986

[54] BOTTLE HAVING CAP WITH SAFETY FEATURE AND COUNTER

[76] Inventor: Christopher J. Dennis, Sunnyside Farm, Brearton, Harrogate, N. Yorkshire, England

[21] Appl. No.: 592,111

[22] Filed: Mar. 22, 1984

[30] Foreign Application Priority Data

Mar. 25, 1983 [GB] United Kingdom ..... 8308231

[51] Int. Cl.[4] ..... B65D 88/38

[52] U.S. Cl. ..... 215/219; 116/308; 215/230

[58] Field of Search ..... 215/219, 203, 220, 230; 116/308

[56] References Cited

U.S. PATENT DOCUMENTS 4,011,829 3/1977 Wachsmann et al. ..... 215/201

4,365,722 12/1982 Kramer ..... 215/220

*Primary Examiner*—George T. Hall

*Attorney, Agent, or Firm*—Bert J. Lewen; Henry Sternberg

[57] ABSTRACT

This invention relates to improvements in bottles and bottle caps and especially to bottles for pills or tablets.

According to invention there is provided a container comprising a bottle (1) with a removable bottle cap (2) the container including counter means, and the bottle (1) and bottle cap (2) including first means and second means respectively, the first and second means being cooperable to increment the counter means (9, 12) each time the bottle cap (2) is removed from or replaced on the bottle (1).

This provides a memory aid to indicate the number of times a bottle has been opened which is especially useful when the container is a medication bottle.

5 Claims, 8 Drawing Figures

Fig.1.
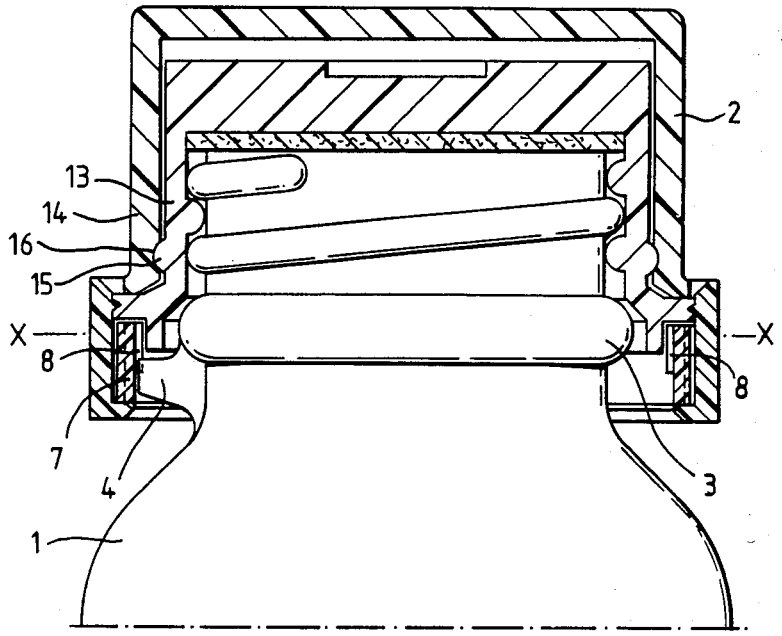
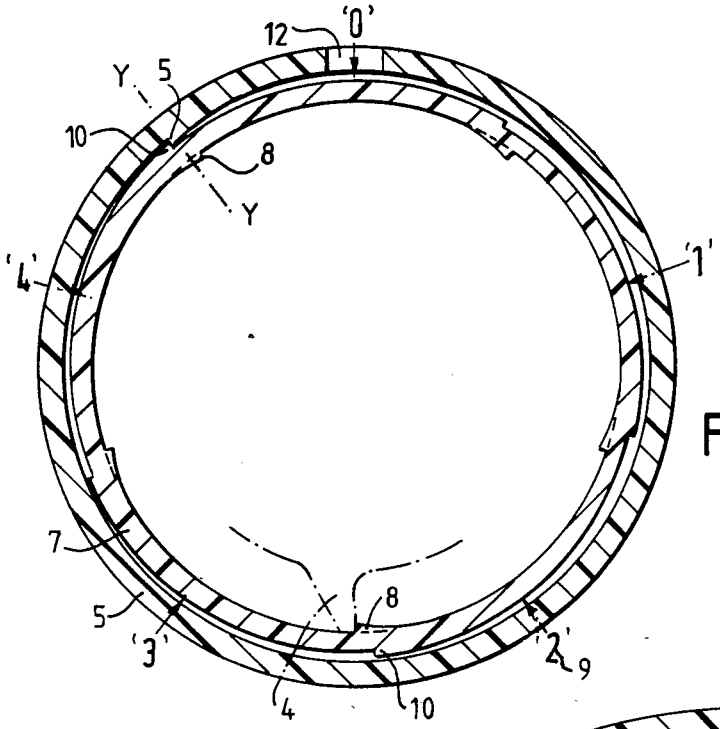
Fig.2.
Fig.3.
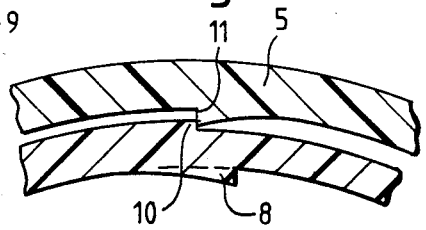

BOTTLE HAVING CAP WITH SAFETY FEATURE AND COUNTER

This invention relates to improvements in bottles and bottle caps and especially to bottles for pills or tablets.

Many of todays drugs are designed to be taken at regular intervals during the day to achieve their effect. This is especially important with heart and blood pressure drugs. Such drugs rely on the regular dosage to prevent illness and a missed dose can prove quite serious. A common problem with patients, especially with elderly patients, is that they get confused and forget how many pills or doses of medicine they have taken and consequently take either too many or too few doses in a day. This is a very difficult problem to overcome since often the confusion is actually caused by the drugs taken.

According to this invention there is provided a container comprising a bottle with a removable bottle cap, the container including counter means, and the bottle and bottle cap including first means and second means respectively, the first and second means being cooperable to increment the counter means each time the bottle cap is removed from or replaced on the bottle.

Thus the counter provides a memory aid to indicate how many times the bottle has been opened and therefore how many times contents have been removed from the bottle. This is most useful when the container is a medication bottle. In this case the counter may indicate how many doses of medication have been taken in a fixed period of time.

The fixed period is preferably 24 hours which is the time period which is used to prescribe almost every medication.

Preferably the counter is automatically incremented by one number either each time the bottle cap is replaced onto the bottle or each time the bottle cap is removed from the bottle.

Preferably the counter counts only so far as the prescribed dosage for the particular medication and then returns to zero so that the patient will know when he has completed his dosage for one day.

As an alternative the counter may just indicate the time when the next dose is to be taken. In this case it is useful if the counter also indicates the data.

The cap for the bottle is preferably a plastic screw threaded cap.

Preferably the cap includes means which engages a stop on the neck of the bottle when the bottle is being close.

Preferably the stop is only engaged when the cap is tightly screwed onto the bottle neck. The engagement of this stop causes the incrementing of the counter.

Preferably the cap includes an annular collar which is rotatably mounted with respect to the cap including a plurality of projections arranged around the circumference of the collar. The collar is located within a fixed outer sleeve. The collar carries a series of numbers regularly spaced around the collar and the outer sleeve includes a window through which only one number at a time may be visible.

When the cap is placed on the bottle and screwed tightly the stop engages one of the projections on the collar. Further advancement of the cap moves the outer sleeve onwards but the collar is fixed with respect to the bottle by the engagement of the stop with the projection. This means that the collar is incremented forward with respect to the sleeve and the next number is shown through the window.

The outer sleeve includes stops on its inner surface against which stops on the outer surface of the collar bear to prevent rotation of the collar with respect to the sleeve when the bottle cap is removed from the bottle.

The bottle cap may also include as an extra safety feature, an inner sleeve fixed to the outer sleeve. The collar rotates between the two sleeves. The inner sleeve includes an opening comprising a small groove which extends for a short distance around the circumference of the sleeve at a position spaced inwards of the edge of the bottle cap and at one end extends to the edge of the bottle cap. This opening accomodates the stop on the bottle neck, but is too small to allow fingers to contact the collar to move it manually with respect to the sleeve when the bottle cap is off the bottle.

Preferably the cap is also a tamper proof cap which can prevent children from tampering with the tablets or medication within the bottle.

A medication bottle and cap in accordance with the invention will now be described, by way of example only, with reference to the accompanying drawings, in which:

FIG. 1 is a section through the bottle and bottle cap;

FIG. 2 is a section across the line X—X of FIG. 1;

FIG. 3 is a detailed view around Y—Y of FIG. 2;

Figure 4:
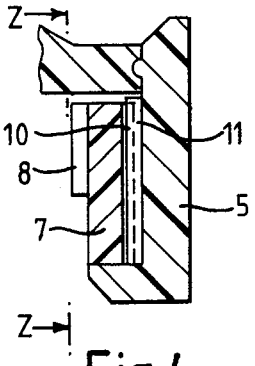
FIG. 4 is a section across the Y—Y of FIG. 2.

A bottle 1 is designed to hold medication, either medicine or tablets. A bottle cap 2 is a screw threadedly engaged with the neck of the bottle 1. The neck 3 of the bottle 1 carries a stop 4 which extends outwards of the bottle at one point around its circumference.

The cap 2 is a tamper-proof, child-proof cap and thus includes an inner cap 13 and an outer cap 14. The inner cap is screw-threaded and includes a projection 15 which cooperates with groove 16 in the outer cap 14. On removing the bottle cap 2, the outer cap 14 is pressed downward so that groove 16 engages projection 15 to allow inner cap 13 to start unscrewing. The inner cap 13 has, relatively fixed thereto, an outer sleeve 5 in which is located a collar 7 relatively rotatable therewith.

The collar 7 includes on its inner surface a series of inwardly directed projections 8 which are engageable by the stop 4 on the bottle neck 3. On its outer surface collar 7 includes a series of figures 9. The number of figures in this case is five, 0, 1, 2, 3, and 4 as shown in FIG. 2. The number of projections 8 equals the number of figures 9. The projections and the figures are exactly evenly spaced about the circumference of the collar 7. The collar 7 also includes five outwardly directed projections 10 which are engageable by a projection 11 on the inner surface of the outer sleeve 5.

Figure 5:
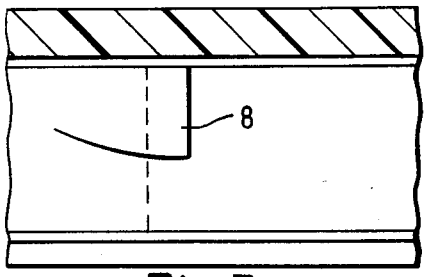
FIG. 5 is a sectional elevation in direction Z—Z of FIG. 4.
Figure 6:
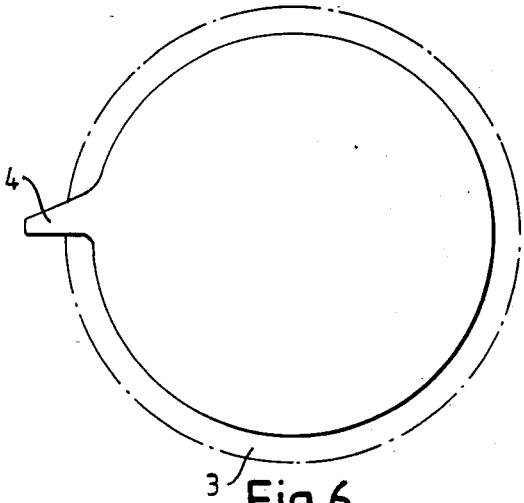
FIG. 6 is a plan view of the bottle neck.
Figure 8:
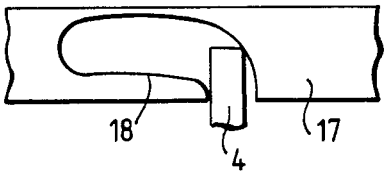
FIG. 8 is a schematic view of an inner sleeve which may be attached to the bottle cap.
Figure 7:
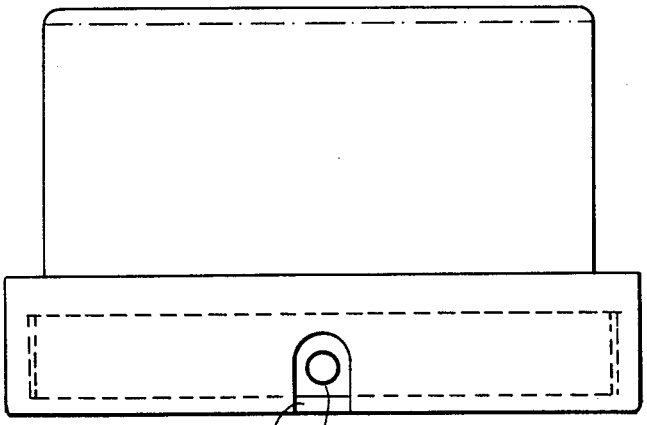
FIG. 7 is an elevation of the bottle cap.

FIG. 5 shows that the projections 10 are curved to make it difficult for the collar 7 to be inadvertently moved when the bottle cap 2 is off the bottle 1. A further safety feature is shown in FIG. 8 and described later.

The outer sleeve 5 includes a window 12 through which may be viewed figures 9 on collar 7.

When the bottle cap 2 is placed on neck 3 of bottle 1 it is screw threaded down until the stop 4 is engaged. The stop 4 engages one of the projections 8 on the collar 7. This fixes the collar with respect to the neck.

Further rotation of the bottle cap 2 causes only outer sleeve 5 to be moved and this movement is continued until sleeve 5 is fully engaged with the bottle, whereupon the next figure 9 is visible through window 12 and, at this position, projection 11 on sleeve 5 has passed the next projection 10 on the collar.

At this point the next figure 9 is visible through the window 12.

When the bottle cap 2 is removed the stop 11 between the outer sleeve and the collar prevents the collar from rotating in the opposite direction with respect to the bottle cap and the number stays visible through the window 12.

When the bottle cap 2 is off the bottle 1 it is almost impossible to increment the collar 7 forwards by accident since the projection 8 is rounded.

However, the inner cap may extend downwards to form inner sleeve 17 shown in FIG. 8. The sleeve 17 includes a groove 18 which accommodates the stop 4. This sleeve 17 prevents the collar 7 being moved forwards when the bottle cap 2 is off the bottle 1.

The number of doses to be taken determines the number of projections 8 on the collar 7. Thus a manufacturer need only manufacture different collars 7 for different doses. A bottle cap may be used which includes a plurality of collars. The dispensing chemist breaks the seal of one collar to allow it to rotate and leaves the other collars 7 fixed to the sleeve 5. The collar 7 chosen depends on the dosage.

I claim:

1. A container comprising a bottle and a cap engageably removable therewith, the container having a fixed stop and the cap including first and second members providing between them indicating means for indicating the number of times the bottle has been opened, said members being movable relative to each other in a first direction to increment said indicating means and having means to prevent relative movement in an opposite direction; said first member having means for engaging the bottle by relative movement therebetween and said second member having means to engage said stop during bottle engaging movement to fix said second member relative to the bottle, so that further bottle engaging movement increments said indicating means.

2. A container according to claim 1 wherein the bottle includes a screw threaded neck and the bottle engaging means on the first member is also screw threaded for engagement with said neck.

3. A container according to claim 1 wherein said second member is arranged on said cap so that engagement with the stop occurs on the last turn of the bottle cap.

4. A container according to claim 1 wherein the bottle cap includes an outer sleeve and an inner collar rotatably mounted within said sleeve, said sleeve including a window whereby a restricted area of collar is exposed, the collar including figures on its outer surface, one of which is visible through the window of the sleeve, the means for engaging the stop being a plurality of inwardly directed projections on the collar.

5. A container according to claim 4 wherein the collar includes further projections on its outer surface, and the outer sleeve includes an inwardly projecting stop on its inner surface, said stop being for engagement with one of said further projections to prevent inadvertent rotation of the collar with respect to the sleeve when the bottle cap is removed from the bottle.

* * * * *